US009604832B2

(12) United States Patent
Brike

(10) Patent No.: US 9,604,832 B2
(45) Date of Patent: Mar. 28, 2017

(54) EXTRACTION COMPONENT FOR A CORKSCREW AND A CORKSCREW

(75) Inventor: Johan L. S. Brike, Illes Baleares (ES)

(73) Assignee: 13° Oblique, Societe Ou Association Sans Personalite Juridique, Grez-Doiceau (BE)

( * ) Notice: Subject to any disclaimer, the term of this patent is extended or adjusted under 35 U.S.C. 154(b) by 237 days.

(21) Appl. No.: 14/127,708

(22) PCT Filed: Jun. 14, 2012

(86) PCT No.: PCT/BE2012/000029

§ 371 (c)(1),
(2), (4) Date: Dec. 19, 2013

(87) PCT Pub. No.: WO2013/006925

PCT Pub. Date: Jan. 17, 2013

(65) Prior Publication Data

US 2014/0123398 A1 May 8, 2014

(30) Foreign Application Priority Data

Jul. 12, 2011 (BE) ..... 2011/0442

(51) Int. Cl.
*B67B 7/04* (2006.01)
*B67B 7/44* (2006.01)

(52) U.S. Cl.
CPC ..... *B67B 7/04* (2013.01); *B67B 7/0423* (2013.01); *B67B 7/44* (2013.01)

(58) Field of Classification Search
CPC .... B67B 7/04; B67B 7/06; B67B 7/44; B67B 7/0423
USPC ..... 81/3.45, 3.35; D8/42
See application file for complete search history.

(56) References Cited

U.S. PATENT DOCUMENTS 989,181 A * 4/1911 Murchie ..... B67B 7/30 30/258
2,738,577 A * 3/1956 Uhrin ..... B67B 7/44 30/446

FOREIGN PATENT DOCUMENTS

FR 2702699 A3 9/1994
FR 2950330 A1 3/2011

OTHER PUBLICATIONS

International Search Report, International Application No. PCT/BE2012/000029 dated Oct. 30, 2012.

* cited by examiner

*Primary Examiner* — Hadi Shakeri
(74) *Attorney, Agent, or Firm* — Dinsmore & Shohl LLP

(57) ABSTRACT

An extraction component for a corkscrew, which comprises a helix that is intended to be screwed into a cork and to this end has a point, whereby the extraction component has means to connect it to other components of the corkscrew, characterized in that the centerline of at least the part of the helix immediately after the point is in a direction that makes a first angle with a straight line that runs through the center of the means and the end of the helix, where the point is located.

11 Claims, 5 Drawing Sheets

EXTRACTION COMPONENT FOR A CORKSCREW AND A CORKSCREW

CROSS-REFERENCE TO RELATED APPLICATIONS

This application is the U.S. national stage of PCT/BE2012/000029 filed Jun. 14, 2012, which claims priority of Belgian Patent Application 2011/0442 filed Jul. 12, 2011.

FIELD OF THE INVENTION

The present invention relates to an extraction component for a corkscrew and a corkscrew.

BACKGROUND OF THE INVENTION

When pulling a cork out of a bottle with a traditional corkscrew, for example a 'sommelier knife', the problem often arises that the cork crumbles or breaks off completely in the middle. In particular, but not exclusively, corks of a lower quality and older corks exhibit this problem.

As a result of this, part of the cork can be left behind in the bottle neck, such that the content of the bottle cannot be poured out until this part has been removed with difficulty. Cork can also get into the wine.

Also with traditional corkscrews, a substantial force is often required to pull a cork out of a bottle.

SUMMARY OF THE INVENTION

The purpose of the present invention is to provide a solution to at least one of the aforementioned and other disadvantages by providing an extraction component for a corkscrew, which comprises a helix that is intended to be screwed into a cork and to this end has a point, whereby the extraction component has means to connect it to other components of the corkscrew, and whereby the centreline of at least the part of the helix immediately after the point is in a direction that makes a first angle with a straight line that runs through the centre of the means and the end of the helix, where the point is located.

When used as a component of an otherwise unadapted corkscrew, the helix of this extraction component will be turned into the cork at an angle to the longitudinal axis of the cork.

As a result, the risk of breaking during extraction is reduced, possibly because when the helix is in an oblique position, the part of the cork on which the force is exerted is greater than with a helix that is placed parallel to the longitudinal axis of the cork, as is usually the case.

In a preferred embodiment, the extraction component contains a helix and a connecting part connected to it.

In a further preferred embodiment, the line segment defined by the centre of the means and the connecting point of the connecting part to the helix forms an included angle of between 160° and 177°, preferably between 165° and 170°, and more preferably 167° to the said centreline.

In further preferred embodiments, the extraction component consists of a helix and a connecting part manufactured from one piece, such that the piece has a bend or kink, and whereby the connecting part is preferably straight and whereby preferably the centreline of the entire helix is straight.

These are simple embodiments of the extraction component according to the invention.

The invention also concerns a corkscrew that contains a handle, a hinged neck support connected to it and an extraction component as described above, whereby the extraction component is secured to the handle via the means.

The advantages of this are analogous to those of the extraction component.

In a preferred embodiment the extraction component is mounted on the handle with hinges and mounted such that the first angle is an angle in the plane that runs through the connecting point of the neck support to the handle and the means, and which is perpendicular to the axis around which the extraction component can hinge.

In a further preferred embodiment, the extraction component is mounted on the handle such that the line segment located in the helix, from the centreline of at least the part of the helix immediately after the point, and the connecting point of the neck support to the handle are on either side of the straight line.

This has the advantage that a substantially lower force is required to extract the cork, such that this extraction is much easier.

This is possibly caused by the cork making a rocking motion during extraction, such that it first comes away from one side of the bottle neck, and then from the other side. Because of this the total pulling force required is better spread over the entire extraction movement, such that the maximum force required is reduced.

A factor in this improvement is also the possibility that the sideways force components resulting from a pulling movement, which traditionally are not usefully applied, i.e. for extracting the cork, indeed contribute to the extraction of the cork with a corkscrew according to the invention.

A change, compared to the known corkscrews, to the way in which the forces exerted on the cork by the extraction component deform the cork during an extraction movement, can also affect the ease with which a cork can be extracted with a corkscrew according to the invention.

Additionally, due to the reduced maximum required force, the risk of the cork breaking is further reduced.

BRIEF DESCRIPTION OF THE DRAWINGS

With the intention of better showing the characteristics of the invention, a preferred embodiment of an extraction component and a corkscrew according to the invention is described hereinafter by way of an example, without any limiting nature, with reference to the accompanying drawings, wherein.

DETAILED DESCRIPTION OF THE PREFERRED EMBODIMENTS

Figure 1:
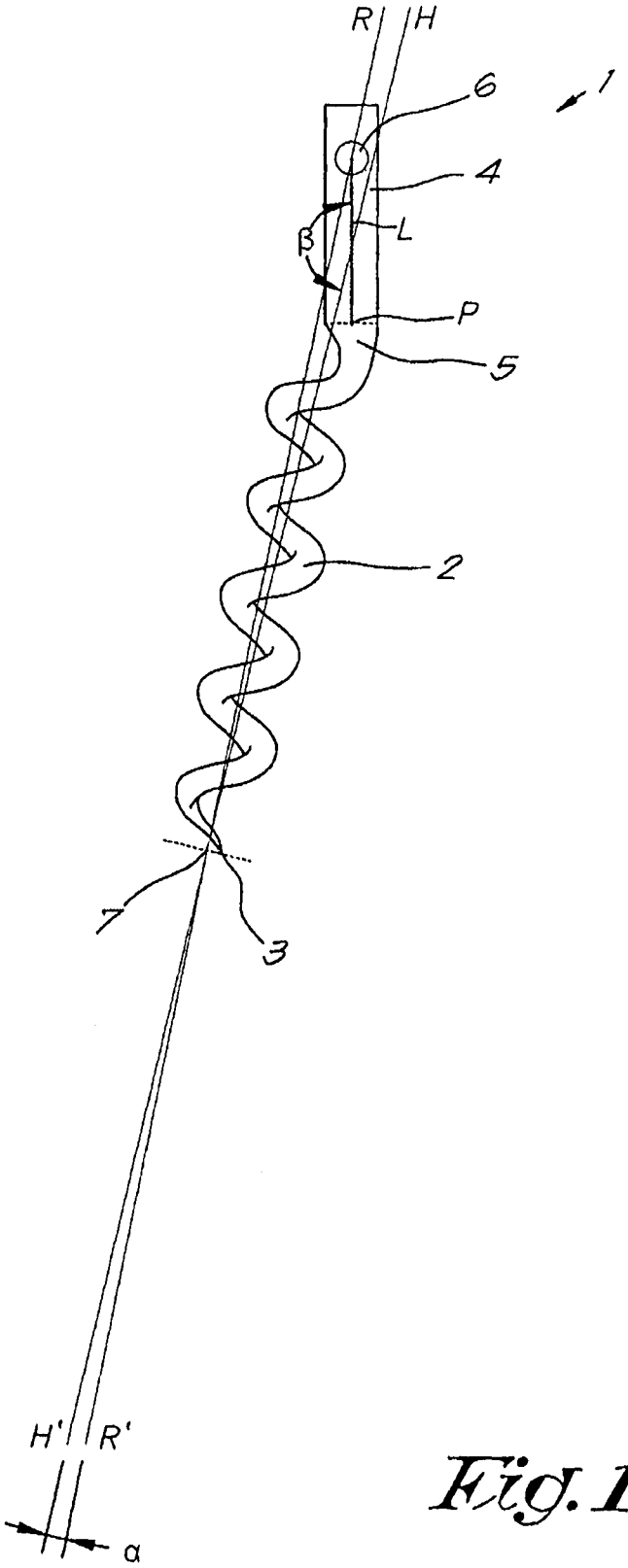
FIG. 1 shows an extraction component according to the invention.

The extraction component 1 of FIG. 1 consists of a helix 2 with a point 3 and a connecting part 4, which in this example, but not necessarily, are made from one piece, whereby the piece has a kink 5.

The helix 2 has a centreline H-H', which in this case is straight, but can also be curved depending on the form of the helix 2.

In the connecting part 4, means are affixed to fasten the extraction component 1 to a corkscrew, in this case but not necessarily, a hole 6 through which a pin can be inserted.

The centreline of the part of the helix 2 immediately after the point 3, which in this case but not necessarily coincides with the centreline H-H' of the entire helix 2, is in a direction that makes an angle α with a straight line R-R' that runs through the centre of the hole 6 and the end 7 of the helix 2 where the point 3 is also located. This end 7 is the point where the centreline H-H' goes outside the helix 2, which comes down to the projection of the point 3 on the centreline H-H'. This does not necessarily correspond to a point on the physical helix 2 and not to the point 3 either.

In this example, the connecting part 4 is, but not necessarily, a straight small rod. The centreline H-H' forms an included angle β of 167° with the line segment L defined by the centre of the hole 6 and the connecting point P of the connecting part 4 to the helix 2, and in this case, but not necessarily, this line segment L coincides with the longitudinal axis of the straight, rod-shaped connecting part 4.

Figure 3:
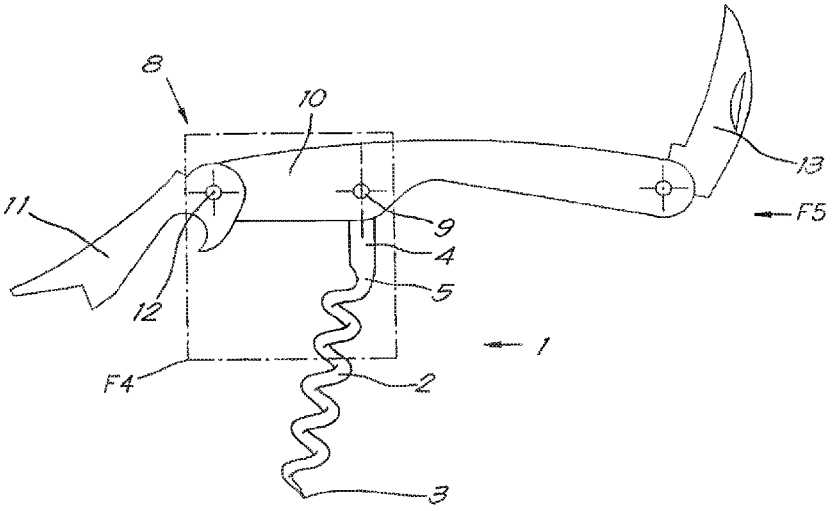
FIG. 3 shows a corkscrew according to the invention, equipped with an extraction component according to FIG. 1.
Figure 4:
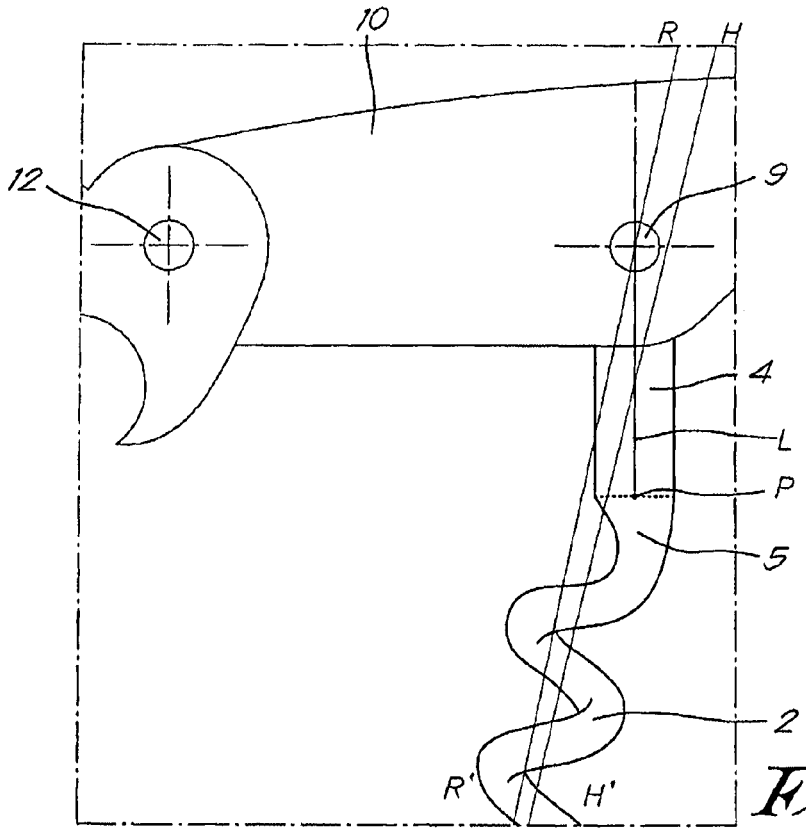
FIG. 4 is an enlarged illustration of the part indicated by F4 in FIG. 3.
Figure 5:
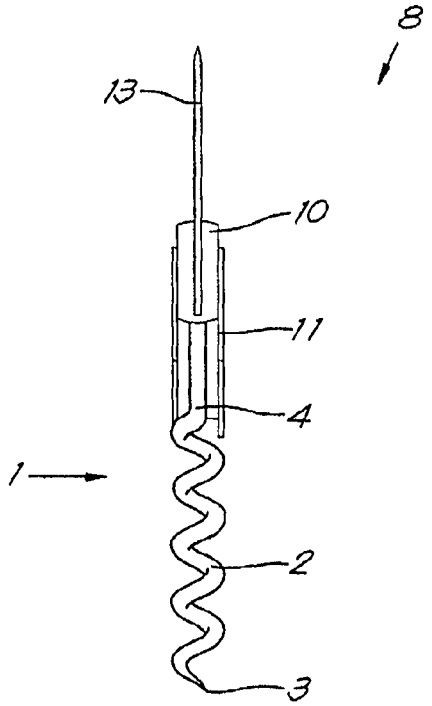
FIG. 5 shows a side view of the corkscrew of FIG. 3, as indicated by F5 in FIG. 3.

The corkscrew 8 shown in FIGS. 3 to 5, a sommelier knife, has an extraction component 1 as described above.

Figure 2:
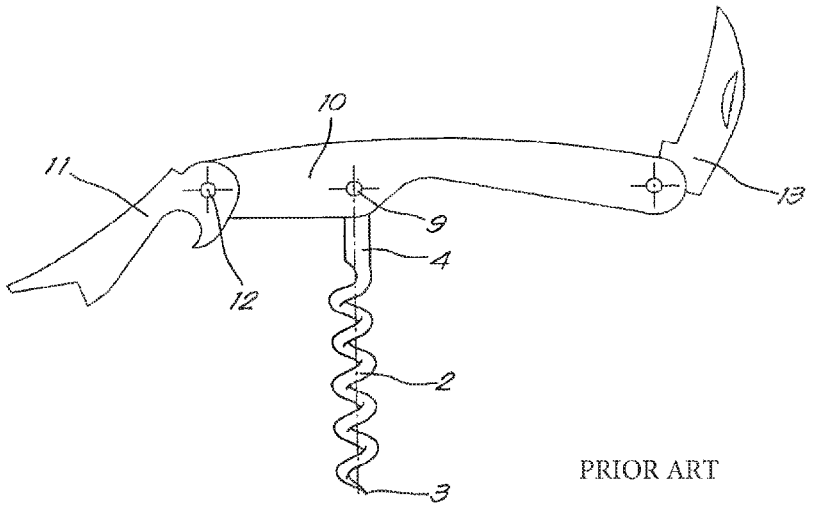
FIG. 2 shows a traditional corkscrew.

As a comparison, FIG. 2 shows a traditional corkscrew with a completely straight extraction component.

The extraction component 1 is secured in a hinged way to the handle 10 of the corkscrew 8 by a small pin 9 inserted through the hole 6.

The corkscrew 8 also has a neck support 11 that is secured to the handle 10 with a hinged connection 12 close to an end of the handle 10, and which is intended to be placed on a bottle neck, and has a knife 13 to cut a capsule from a wine bottle. The hinge axes around which the neck support 11 and the extraction component 1 can hinge with respect to the handle 10 are parallel.

The angles α and β are located in the plane that runs through the hinged connection 12 and the hole 6, and which is perpendicular to the hinge axes of the neck support 11 and the extraction component 1.

The extraction component 1 is mounted such that the line segment of the centreline H-H' located in the helix 2, in this case the line segment from point 7 to the contact point with line segment L, and the hinged connection 12 to which the neck support 11 is secured, are on either side of the straight line R-R'.

Figure 6:
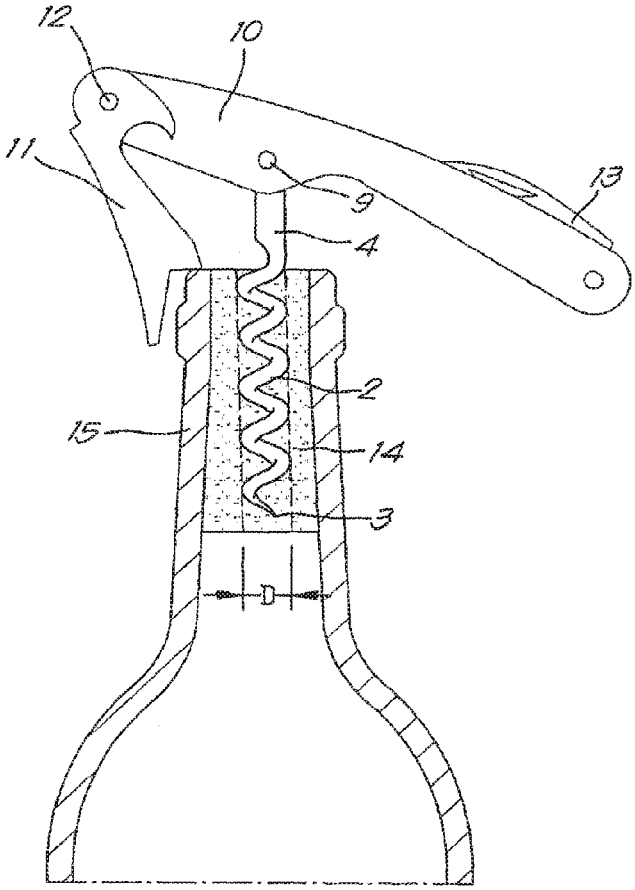
PRIOR ART Fig.6
FIGS. 6 and 7 show the use of the corkscrews according to FIGS. 2 and 3.
Figure 7:
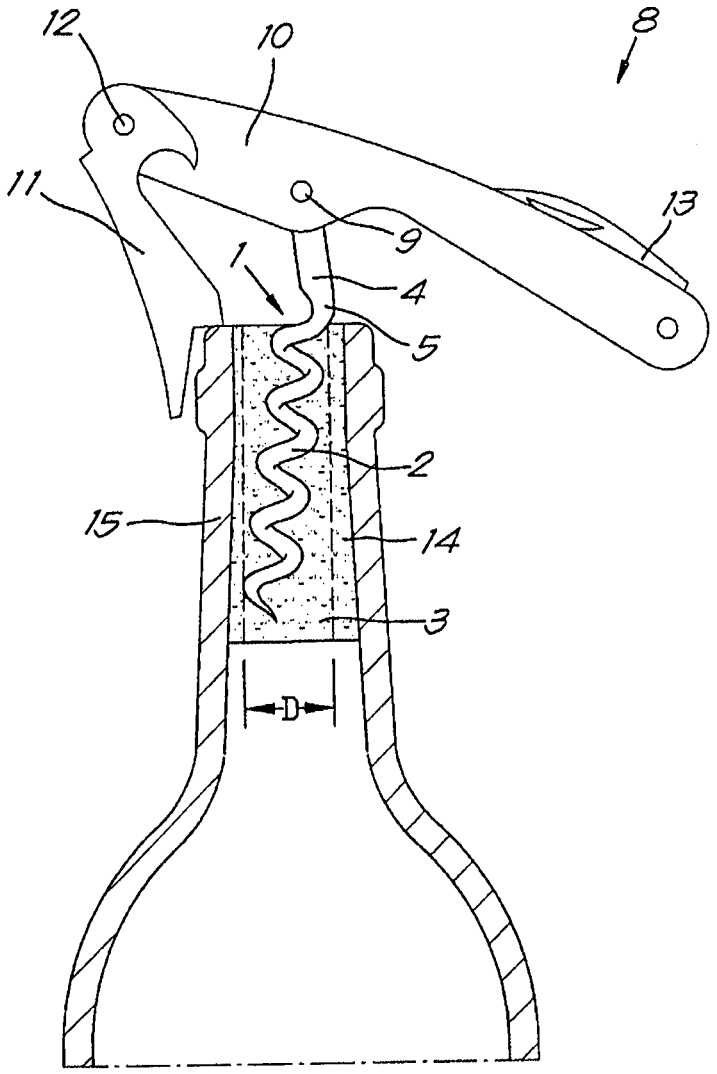

The use of a corkscrew 8 according to the invention is simple and as follows, and is shown in FIG. 7, whereby the use of a traditional corkscrew is shown in FIG. 6 as a comparison.

The corkscrew 8 is placed with its point 3 on a cork 14 in the traditional way. By turning the handle around the line segment L-L', the helix 2 is screwed into the cork 14, whereby it goes into the cork 14 obliquely. Then the neck support 11 is placed on the neck 15 of the bottle. This is the position of the corkscrew 8 shown in FIG. 7.

Then an upward force is exerted, primarily at the end of the handle 10 where the knife 13 is located. This force is transmitted to the part D of the cork 14. It is clear from a comparison between FIGS. 6 and 7 that the part D is larger when using the corkscrew 8 according to the invention than with the use of a traditional corkscrew.

As a result, the exerted force is distributed more in the cork 14, and the risk of its breaking strength being exceeded locally in the cork 14, resulting in a fracture of the cork 14, is lower with a corkscrew 8 according to the invention than with a traditional corkscrew.

As a result of the force exerted by the helix 2 on the cork 14, the cork 14 will now be pulled out of the neck 15.

As a result of the angle β in the extraction component 1, the force exerted on the handle 10 is transmitted to the cork 14 such that it can be easily extracted from the neck 15 by making a rocking motion.

As a result, right from the start of the extraction movement, the force exerted on the cork 14 is partially sideways, so that the distribution of the forces in the cork 14 is improved compared to a traditional corkscrew.

As a result the user needs to exert less force on the handle 10 than with a traditional corkscrew.

The present invention is by no means limited to the embodiments described as an example and shown in the drawings, but an extraction component and a corkscrew according to the invention can be realised in all kinds of variants, without departing from the scope of the invention.

The invention claimed is:

1. A corkscrew comprising a handle, an extraction component that is secured to the handle via a pivot point and a neck support connected to the handle at a connection point at a first end, whereby said extraction component comprises a helix extending from a connecting part and tilting towards said first end, the helix with a penetration point at its distal end that is intended to be screwed into a cork, the distal end of said helix having a part immediately adjacent to said penetration point with a centerline passing through a center point disposed on said centerline and disposed in a plane being orthogonal to said centerline and containing the penetration point of the extraction component, wherein said centerline makes an angle (α) with a straight line that runs from the center point through a center of the pivot point of the extraction component, wherein the extraction component is mounted on the handle such that a portion of the centerline adjacent to the handle and the connection point of the neck support to the handle are on opposite sides of said straight line.

2. The corkscrew according to claim 1, characterised in that a longitudinal axis of the connecting part forms an included angle between 160° and 177° with the said centerline.

3. The corkscrew according to claim 1, characterised in that the included angle is between 165° and 170°.

4. The corkscrew according to claim 1, characterised in that the helix and the connecting part that are manufactured as a single piece, whereby the single piece has a bend or a kink separating the helix from the connecting part.

5. The corkscrew according to claim 1, characterised in that the connecting part is straight.

6. The corkscrew according to claim 1, characterised in that it is a corkscrew of the sommelier knife type.

7. A corkscrew comprising a handle, an extraction component with a helix and a connection part that is secured to the handle by a pivot point, the corkscrew further comprising a neck support connected to the handle at a connection point at a first end, whereby the helix is tilting towards said first end and is provided with a penetration point at its distal end that is intended to be screwed into a cork, the distal end of said helix having a part immediately adjacent to said penetration point with a centerline passing through a center point disposed on said centerline and disposed in a plane being orthogonal to said centerline and containing the penetration point of the extraction component, wherein the longitudinal axis of the connecting part forms an included angle (β) between 160° and 177° with said centerline and wherein the extraction component is mounted on the handle such that a portion of the centerline adjacent to the handle and the connection point of the neck support to the handle are on opposite sides of said straight line that runs from the center point through the center of the pivot point of the extraction component.

8. The corkscrew according to claim 7, wherein the included angle (β) is between 165° and 170°.

9. The corkscrew according to claim 7, wherein the centerline makes an angle (α) with the straight line that runs from the center point through the center of the pivot point of the extraction component.

10. A method of removing a cork from a neck of a bottle, the method comprising the following steps:

providing a corkscrew including a handle, an extraction component that is secured to the handle via a pivot point and a neck support connected to the handle at a connection point at a first end, whereby said extraction component comprises a helix extending from a connecting part and tilting towards said first end, the helix with a penetration point at its distal end that is intended to be screwed into a cork, the distal end of said helix having a part immediately adjacent to said penetration point with a centerline passing through a center point disposed on said centerline and disposed in a plane being orthogonal to said centerline and containing the penetration point of the extraction component, wherein said centerline makes an angle (α) with a straight line that runs from the center point through a center of the pivot point of the extraction component, wherein the extraction component is mounted on the handle such that a portion of the centerline adjacent to the handle and the connection point of the neck support to the handle are on opposite sides of the said straight;

placing the corkscrew with the penetration point of its helix on the cork;

screwing the helix of the corkscrew into the cork by turning the handle, taking care that the helix of the corkscrew goes into the cork obliquely with respect to the axial direction of the neck of the bottle;

placing the neck support on the neck of the bottle;

exerting an upward force on the handle on the opposite side of the neck support so as to make a rocking motion.

11. A method of removing a cork from a neck of a bottle, the method comprising the following steps:

providing a corkscrew including a handle, an extraction component with a helix and a connection part that is secured to the handle by a pivot point, the corkscrew further comprising a neck support connected to the handle at a connection point at a first end, whereby the helix is tilting towards said first end and is provided with a penetration point at its distal end that is intended to be screwed into a cork, the distal end of said helix having a part immediately adjacent to said penetration point with a centerline passing through a center point disposed on said centerline and disposed in a plane being orthogonal to said centerline and containing the penetration point of the extraction component, wherein the longitudinal axis of the connecting part forms an included angle (β) between 160 and 177" with said centerline and wherein the extraction component is mounted on the handle such that a portion of the centerline adjacent to the handle and the connection point of the neck support to the handle are on opposite sides of said straight line that runs from the center point through the center of the pivot point of the extraction component;

placing the corkscrew with the penetration point of its helix on the cork;

screwing the helix of the corkscrew into the cork by turning the handle, taking care that the helix of the corkscrew goes into the cork obliquely with respect to the axial direction of the neck of the bottle;

placing the neck support on the neck of the bottle;

exerting an upward force on the handle on the opposite side of the neck support by making a rocking motion.

* * * * *